US006649276B1

(12) United States Patent
Kanemitsu et al.

(10) Patent No.: US 6,649,276 B1
(45) Date of Patent: Nov. 18, 2003

(54) SHEET METAL MEMBER AND METHOD OF MANUFACTURING THE MEMBER

(75) Inventors: Toshiaki Kanemitsu, Akashi (JP); Yasuhiro Takahashi, Akashi (JP); Kunihiro Harada, Akashi (JP)

(73) Assignee: Kanemitsu Corporation, Akashi (JP)

( * ) Notice: Subject to any disclaimer, the term of this patent is extended or adjusted under 35 U.S.C. 154(b) by 126 days.

(21) Appl. No.: 09/805,779

(22) PCT Filed: Jun. 16, 2000

(86) PCT No.: PCT/JP00/03919

§ 371 (c)(1),
(2), (4) Date: Mar. 20, 2001

(87) PCT Pub. No.: WO01/07183

PCT Pub. Date: Feb. 1, 2001

(30) Foreign Application Priority Data

Jul. 28, 1999 (JP) ..... 11-213784

(51) Int. Cl.[7] ..... B21J 5/06; B21K 21/08; B60R 21/26

(52) U.S. Cl. ..... 428/579; 72/379.2; 72/377

(58) Field of Search ..... 428/579, 582, 428/586, 598, 599, 595, 603, 600; 72/379.2, 370, 377, 352, 354.6, 355.2, 355.4

(56) References Cited

U.S. PATENT DOCUMENTS 4,439,907 A * 4/1984 Block et al. ..... 29/432.1
5,129,146 A * 7/1992 Kanemitsu et al. ..... 29/892
5,448,832 A * 9/1995 Kanemitsu et al. ..... 29/892.2
5,806,358 A * 9/1998 Rolf ..... 72/110
5,931,042 A * 8/1999 Kanemitsu et al. .... 29/894.362
5,937,691 A * 8/1999 Kanemitsu et al. ..... 72/355.4
5,941,113 A * 8/1999 Kanemitsu et al. ..... 72/110
6,012,318 A * 1/2000 Kanemitsu et al. ..... 29/892

FOREIGN PATENT DOCUMENTS

| | | |
|---|---|---|
| FR | 2265590 | * 11/1975 |
| GB | 2141654 | * 1/1985 |
| JP | 58-202933 | * 11/1983 |
| JP | 60-35487 | 2/1985 |
| JP | 2-117729 | * 5/1990 |
| JP | 10-202339 | 8/1998 |
| JP | 10-211532 | * 8/1998 |
| JP | 10-211533 | * 8/1998 |

* cited by examiner

*Primary Examiner*—John J. Zimmerman
(74) *Attorney, Agent, or Firm*—Jones, Tullar & Cooper, P.C.

(57) ABSTRACT

According to the invention, an inward collar is integrally shaped on the inner periphery of a cylindrical boss portion. The inward collar is raisedly shaped in the axial direction on the inner periphery of the cylindrical boss portion by a top pattern tool having an ironing punch, and a bottom pattern tool having an ironing punch. The ironing process of forming the inward collar is repeated several times by using plural dies to finish the final shape.

2 Claims, 4 Drawing Sheets

SHEET METAL MEMBER AND METHOD OF MANUFACTURING THE MEMBER

TECHNICAL FIELD

The present invention relates to a sheet metal member that is formed into a shape in which a flange portion is projected outward integrally around the whole periphery of a cylindrical boss portion, and that can be used as, for example, a housing lower part of a gas generator of an air bag for an automobile, and also to a method of producing the member.

BACKGROUND ART

Conventionally, it is well known that a sheet metal member of the shape having: a cylindrical boss portion; and a flange portion which is projected outward integrally around the whole periphery of the boss portion is obtained by using a thin disk-like blank. However, there exists no sheet metal member in which an inward collar is raisedly shaped by an ironing process on the inner periphery of an axial intermediate portion of the boss portion of the sheet metal member, and no processing technique for it.

SUMMARY OF THE INVENTION

It is an object of the invention to provide a sheet metal member in which an inward collar is raisedly shaped by an ironing process on the inner periphery of an axial intermediate portion of a cylindrical boss portion of such a sheet metal member of the shape wherein a flange portion projects outwardly and integrally around the entire periphery of the boss portion, and also a method of producing the member.

It is another object of the invention to provide a sheet metal member which presents such a shape, which is light, and which is durable.

It is a further object of the invention to provide a production method in which a sheet metal member presenting such a shape can be easily produced in steps the number of which is as small as possible, at a low cost, and with forming no cut chip so as to reduce the material.

The sheet metal member of the invention is a sheet metal member having: a cylindrical boss portion; and a flange portion which is projected outward integrally around a whole periphery of the boss portion, and characterized in that an inward collar is shaped on an inner periphery of an axial intermediate portion of the boss portion, the inward collar being raised toward an axial center by thinly ironing an inner peripheral wall of the boss portion.

The thus configured sheet metal member is light and has good durability.

The method of producing a sheet metal member of the invention is characterized in that the method comprises the steps of: shaping a semifinished product from a thin disk-like blank, the semifinished product having a cylindrical boss portion, and a flange portion which is projected outward integrally around a whole periphery of the boss portion; and clampingly holding the semifinished product between a top pattern tool which has an ironing punch at a center in a vertically movable manner, and a bottom pattern tool which has similarly an ironing punch at a center in a vertically movable manner, and thinly ironing an inner peripheral wall of the boss portion by pressingly inserting the ironing punch of the top pattern tool into the boss portion from an upper side, and the ironing punch of the bottom pattern tool into the boss portion from a lower side, whereby an inward collar is raisedly shaped toward an axial center on an inner periphery of an axial intermediate portion of the boss portion.

Preferably, an ironing process of shaping the inward collar is repeated several times to finish the inward collar of a final shape.

According to this production method, a sheet metal member in which an inward collar is shaped on the inner periphery of the axial intermediate portion of the boss portion can be easily obtained by an ironing process using a thin disk-like blank and the ironing punches of the top and bottom pattern tools, in a reduced number of steps, at a low cost, and with forming no cut chip to economically use the material.

DESCRIPTION OF THE PREFERRED EMBODIMENT OF THE INVENTION

Figure 1:
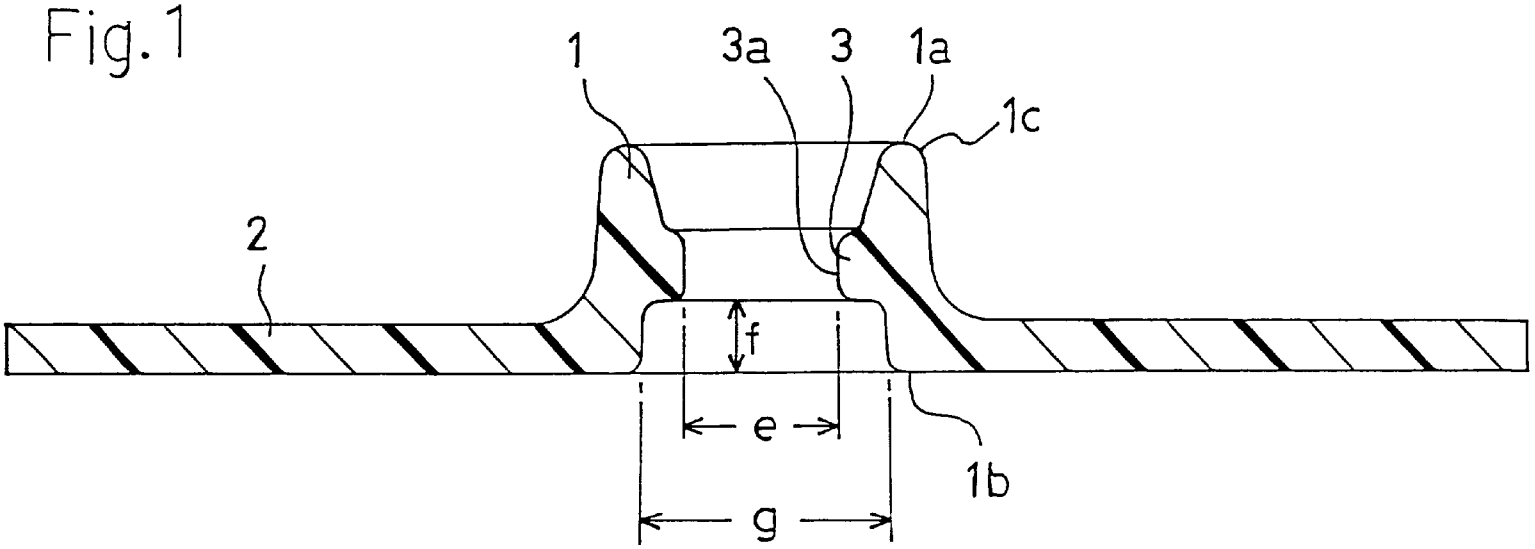
FIG. 1 is a section view of a sheet metal member.
Figure 2:
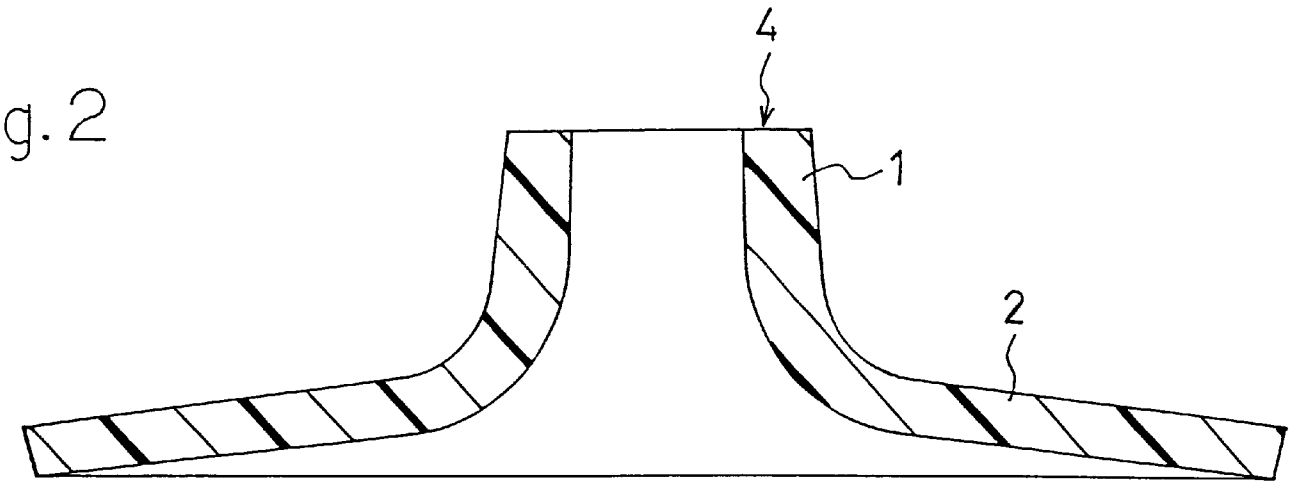
FIG. 2 is a section view of a semifinished product of the sheet metal member.

Hereinafter, an embodiment of the invention will be described with reference to the drawings. FIG. 1 is a section view of the sheet metal member of the invention, FIG. 2 is a section view of a semifinished product of the sheet metal member of the invention, and FIGS. 3A to 3D are views showing steps of producing the sheet metal member. In FIGS. 2A to 3D, the semifinished product, a top pattern tool, and a bottom tool are shown in a half-section state because they are bilaterally symmetrical.

The sheet metal member of the invention is configured by a thin disk-like blank of a steel plate. As shown in FIG. 1, a flange portion 2 is projected outward integrally around the whole periphery of a cylindrical boss portion 1, and an inward collar 3 is integrally shaped on the inner periphery of an axial intermediate portion of the boss portion 1. The inward collar 3 is raisedly shaped toward the axial center by thinly ironing the inner peripheral wall of the boss portion 1.

The thus configured sheet metal member is light and tough, and has good durability. Therefore, the sheet metal member is preferably used as, for example, a housing lower part of a gas generator of an air bag for an automobile, and other various kinds of mechanical parts.

Next, an example of the method of producing the sheet metal member will be described with reference to FIGS. 2 and 3A to 3D.

As shown in FIG. 2, first, a semifinished product 4 of a shape which has the cylindrical boss portion 1 and the flange portion 2 that is projected outward integrally around the whole periphery from one axial end of the boss portion 1 is previously shaped by a drawing process using a thin disk-like blank of a steel plate.

Next, the semifinished product is transferred to an ironing step for forming the inward collar 3 on the inner periphery of an axial intermediate portion of the boss portion 1. In the illustrated example, the inward collar 3 is finished to a final shape by the ironing process separated into first to fourth phases as shown in FIGS. 3A to 3D.

Figure 3A:
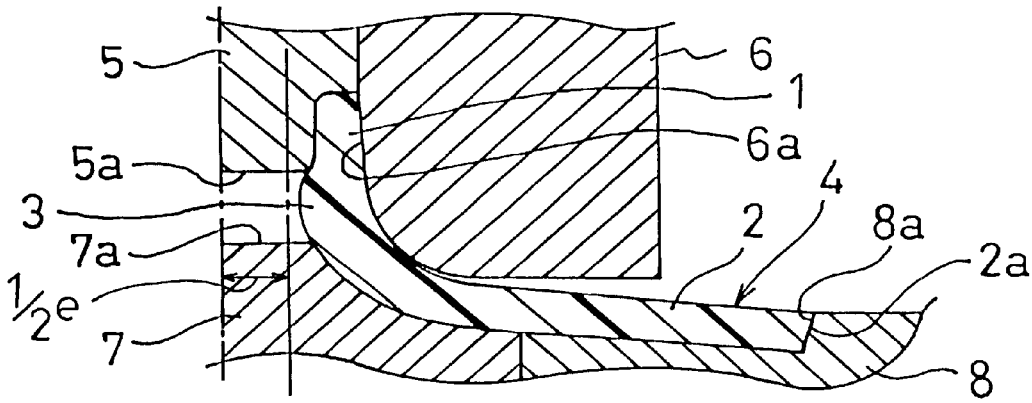
FIG. 3A is a half section view showing a state of a first ironing phase of the sheet metal member.

In the first ironing phase, as shown in FIG. 3A, a top pattern tool 6 which has a tapered ironing punch 5 at the center in a vertically movable manner, and a bottom pattern tool 8 which has similarly a tapered ironing punch 7 at the center in a vertically movable manner are used. The semifinished product 4 is clampingly held between the top and bottom pattern tools 6 and 8. At this time, the outer periphery of the boss portion 1 is restrained by an inner peripheral wall portion 6*a* of the top pattern tool 6, and an outer peripheral edge 2*a* of the flange portion 2 is restrained by a step portion 8*a* of the bottom pattern tool 8 so as not to escape toward a radially outer side. Then, a tip end portion 5*a* of the ironing punch 5 of the top pattern tool 6 is pressingly inserted into the boss portion 1 of the semifinished product 4 from the upper side, and a tip end portion 7*a* of the ironing punch 7 of the bottom pattern tool 8 is pressingly inserted into the boss portion 1 from the lower side, to thinly iron the inner peripheral wall of the boss portion 1, whereby a material formed in front of the tip end portions 5*a* and 7*a* of the upper and lower ironing punches 5 and 7 is raised on the inner periphery of the axial intermediate portion of the boss portion 1 to preliminarily cold-shape the inward collar 3.

Figure 3B:
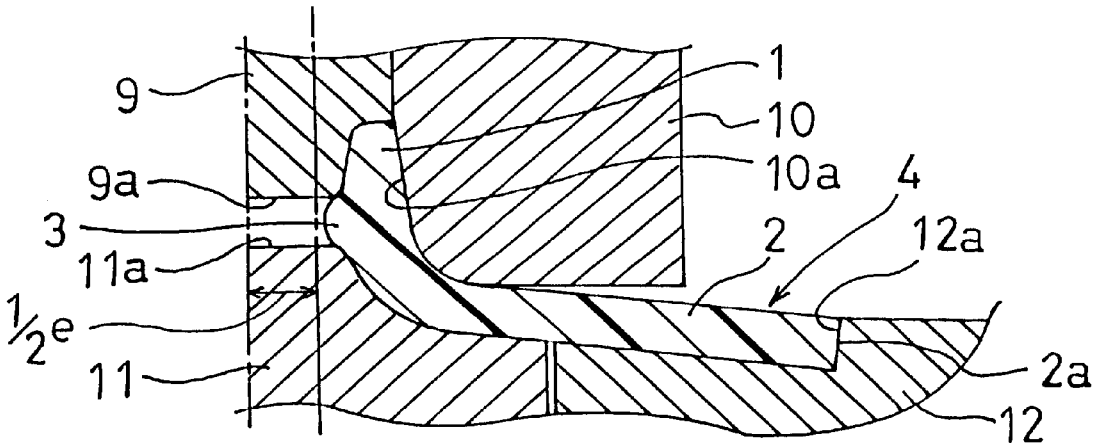
FIG. 3B is a half section view showing a state of a second ironing phase.

In the second ironing phase, as shown in FIG. 3B, a top pattern tool 10 which has a tapered ironing punch 9 at the center in a vertically movable manner, and a bottom pattern tool 12 which has similarly a tapered ironing punch 11 at the center in a vertically movable manner are used in the same manner as the first ironing phase. At this time, the length and thickness of each of tip end portions 9*a* and 11*a* of the upper and lower ironing punches 9 and 11 are set to be slightly larger than those of the tip end portions 5*a* and 7*a* of the upper and lower ironing punches 5 and 7 which are used in the first ironing phase. In the second ironing phase, therefore, the semifinished product 4 which is obtained in the first ironing phase is clampingly held between the top and bottom pattern tools 10 and 12, and the tip end portions 9*a* and 11*a* of the upper and lower ironing punches 9 and 11 are pressingly inserted into the boss portion 1 to further thinly iron the inner peripheral wall of the boss portion 1, whereby the inward collar 3 can be further raised. Of course, also in this case, during the ironing process, the outer periphery of the boss portion 1 is restrained by an inner peripheral wall portion 10*a* of the top pattern tool 10, and the outer peripheral edge 2*a* of the flange portion 2 is restrained by a step portion 12*a* of the bottom pattern tool 12 so as not to escape toward a radially outer side.

Figure 3C:
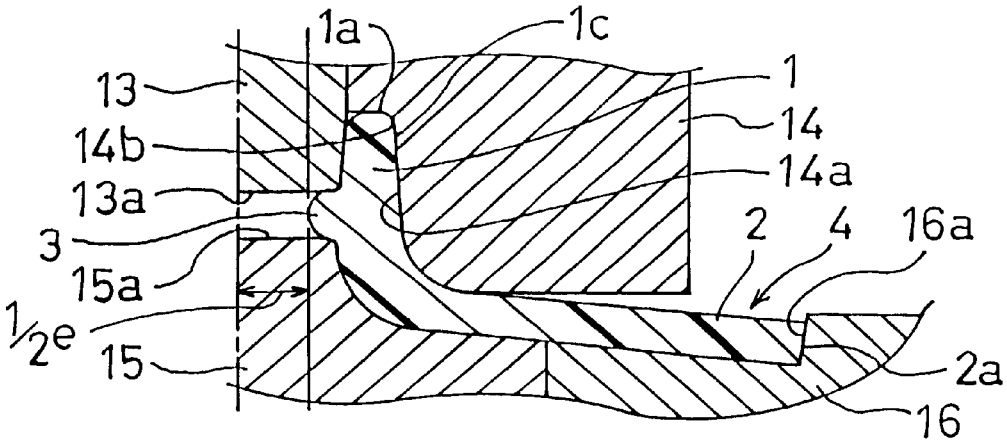
FIG. 3C is a half section view showing a state of a third ironing phase.

In the third ironing phase, as shown in FIG. 3C, a top pattern tool 14 which has a tapered ironing punch 13 at the center in a vertically movable manner, and a bottom pattern tool 16 which has similarly a tapered ironing punch 15 at the center in a vertically movable manner are used in the same manner. At this time, the length and thickness of each of tip end portions 13*a* and 15*a* of the upper and lower ironing punches 13 and 15 are set to be slightly larger than those of the tip end portions 9*a* and 11*a* of the upper and lower ironing punches 9 and 11 which are used in the second ironing phase. In the third ironing phase, therefore, after the semifinished product 4 which is obtained in the second ironing phase is clampingly held between the top and bottom pattern tools 14 and 16, the outer periphery of the boss portion 1 is restrained by an inner peripheral wall portion 14*a* of the top pattern tool 14, and the outer peripheral edge 2*a* of the flange portion 2 is restrained by a step portion 16*a* of the bottom pattern tool 16, the tip end portions 13*a* and 15*a* of the upper and lower ironing punches 13 and 15 are pressingly inserted into the boss portion 1 to further thinly iron the inner peripheral wall of the boss portion 1, whereby the inward collar 3 is further raised to shape the semifinished product to a state similar to a desired height. In the third ironing phase, as required, also a process in which an outer edge portion 1*c* of a projecting end face 1*a* of the boss portion 1 is rounded by an recessed edge portion 14*b* of the inner periphery of the top pattern tool 14 restraining the outer periphery of the boss portion 1 is conducted.

Figure 3D:
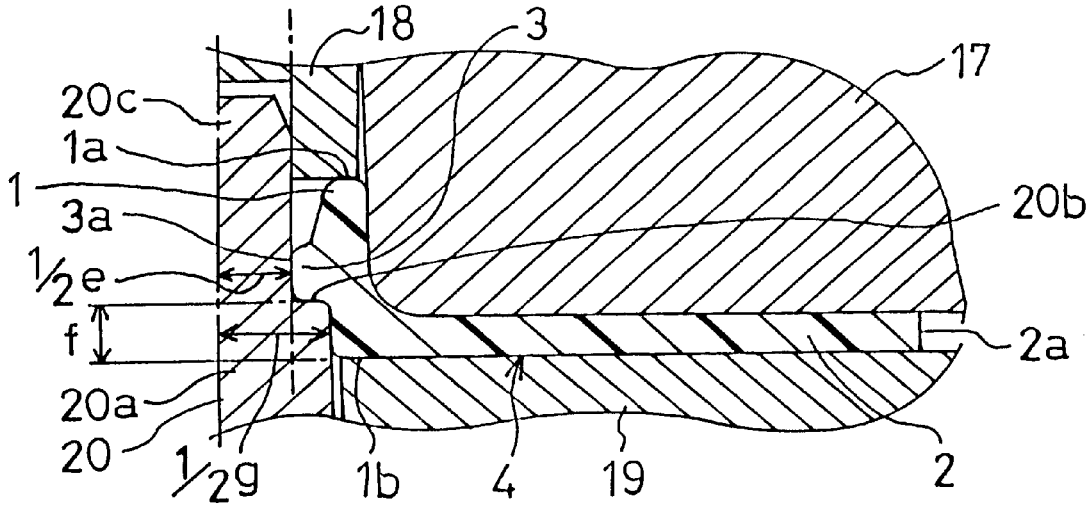
FIG. 3D is a half section view showing a state of a fourth ironing phase.

Another part or another member must be built into the boss portion 1 of the finished sheet metal member. In order to attain the object, in the fourth ironing phase, as shown in FIG. 3D, shaping is conducted so that the inner diameter e of the inward collar 3 of the semifinished product 4 which is obtained in the third ironing phase has a predetermined dimension, the inner end face 3*a* of the collar is flat, and, in the inward collar 3, the depth f from another end face 1*b* opposite to the projecting end face 1*a* of the boss portion 1 has a predetermined dimension, and the inner diameter g on the side of the other end face 1*b* of the boss portion 1 has a predetermined dimension.

In the fourth ironing phase, therefore, a punch 18 which presses the projecting end face 1*a* of the boss portion 1 is provided at the center of a top pattern tool 17, and a stepped shaping punch 20 having a large-diameter shaft portion 20*a*, and a small-diameter shaft portion 20*c* which is continuous via a stepped portion 20*b* to a tip end side of the large-diameter shaft portion 20*a* is provided at the center of a bottom pattern tool 19.

In the fourth ironing phase, consequently, the semifinished product 4 which is obtained in the third ironing phase is clampingly held between the top and bottom pattern tools 17 and 19, the projecting end face 1*a* of the boss portion 1 is pressed by the punch 18 of the top pattern tool 17, and the shaping punch 20 of the bottom pattern tool 19 is pressingly inserted into the boss portion 1, with the result that shaping is conducted so that, in the small-diameter shaft portion 20*c*, the inner diameter e of the inward collar 3 has the predetermined dimension, the inner end face 3*a* of the collar is flattened, and, in the large-diameter shaft portion 20*a*, the inner peripheral wall of the boss portion 1 is thinly ironed, whereby the depth f of the inward collar 3 from the other end face 1*b* of the boss portion has the predetermined dimension, and the inner diameter g of the boss portion 1 on the side of the other end face 1*b* has the predetermined dimension. As a result, a finished product of the sheet metal member is obtained. In the fourth ironing phase, when the outer peripheral edge 2*a* of the flange portion 2 is set so as not to be restrained by the bottom pattern tool 19, the flange 2 may be thinly stretched toward a radially outer side by pressing of the top pattern tool 17.

Figure 4:
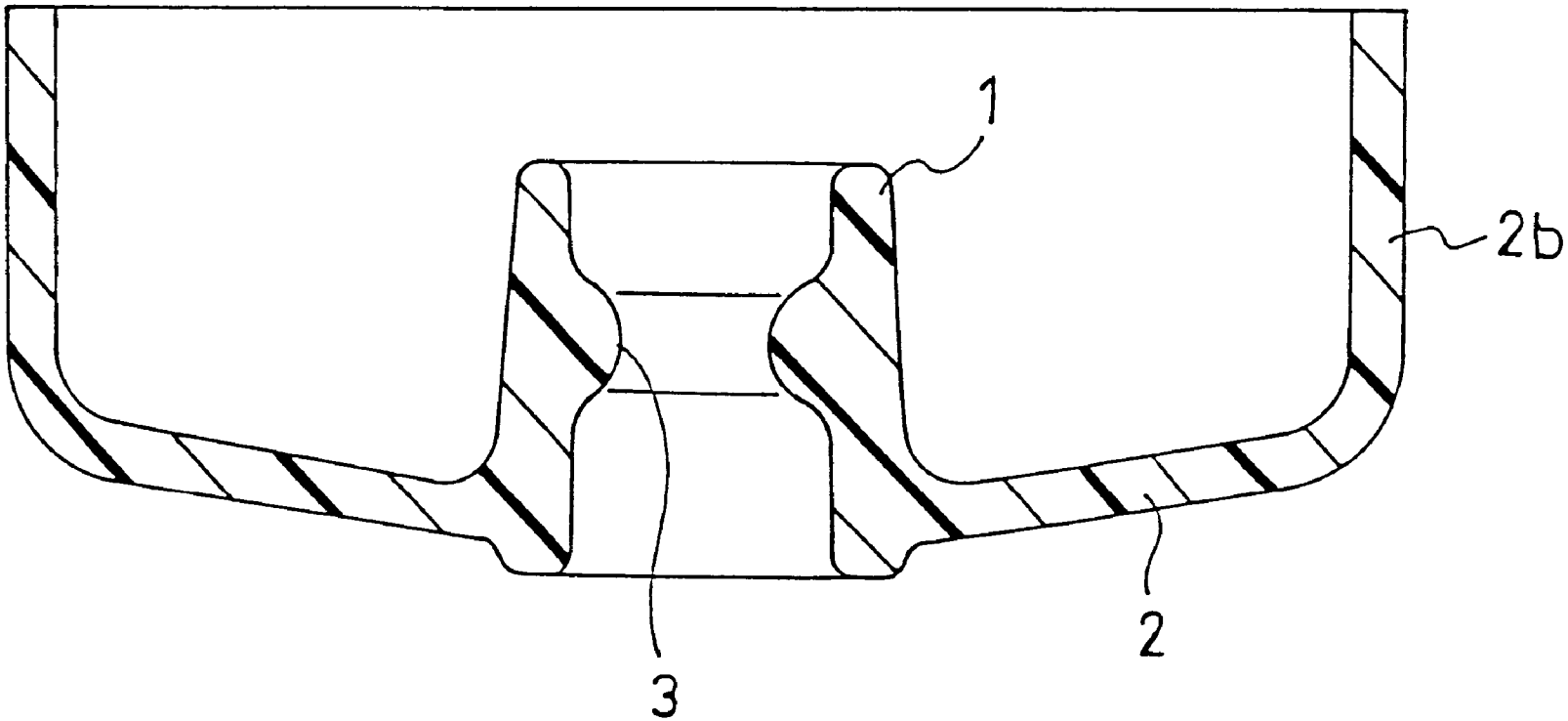
FIG. 4 is a section of a sheet metal member of another embodiment.

As the sheet metal member, the invention can be similarly applied to a member in which, as shown in FIG. 4, the flange portion 2 is bent into a cylindrical shape so that its outer peripheral end portion 2*b* is opposed in substantially parallel to the outer periphery of the boss portion 1.

According to the sheet metal member of the invention, as a sheet metal member having: a cylindrical boss portion; a flange portion which projects outwardly and integrally around the entire periphery of the boss portion; and an inward collar which is raisedly shaped on the inner periphery of an axial intermediate portion of the boss portion, a member which is light and durable can be obtained. For example, the member can be preferably used as a housing lower part of a gas generator of an air bag for an automobile.

According to the method of producing a sheet metal member of the invention, a sheet metal member having: a cylindrical boss portion; a flange portion which is projected outward integrally around the whole periphery of the boss portion; and an inward collar which is raisedly shaped on the inner periphery of an axial intermediate portion of the boss portion can be easily economically produced in a reduced number of steps, and without losing a raw material of the material.

What is claimed is:

1. A method of producing a sheet metal member from a thin disk shaped metal blank, comprising the steps of:

providing a thin disk shaped metal blank;

shaping a semifinished product from the thin disk shaped metal blank, the semifinished product when shaped having a cylindrical boss portion, and a flange portion which projects outwardly and integrally around the entire periphery of the boss portion, the boss portion defining an axial center and an inner peripheral wall;

clampingly holding the semifinished product between a top pattern tool which has an ironing punch at its center in a vertically movable manner, and a bottom pattern tool which similarly has an ironing punch at its center in a vertically movable; and thinly ironing the inner peripheral wall of the boss portion by pressingly inserting the ironing punch of the top pattern tool into the boss portion from an upper side, and the ironing punch of the bottom pattern tool into the boss portion from a lower side, whereby an inward collar is raised toward the axial center on an inner periphery of an axial intermediate portion of the boss portion.

2. The method of producing a sheet metal member according to claim 1, wherein said thinly ironing is repeated several times to finish the inward collar to a final shape.

* * * * *

UNITED STATES PATENT AND TRADEMARK OFFICE

CERTIFICATE OF CORRECTION

PATENT NO. : 6,649,276 B1 
DATED : November 18, 2003
INVENTOR(S) : Toshiaki Kanemitsu, Yasuhiro and Kunihiro Harada It is certified that error appears in the above-identified patent and that said Letters Patent is hereby corrected as shown below:

Column 6,
Line 5, the word -- manner -- should be inserted so it reads as follows:
"in a vertically movable manner; and"

Signed and Sealed this

Ninth Day of August, 2005

JON W. DUDAS
*Director of the United States Patent and Trademark Office*